US010343426B2

(12) United States Patent
Fujino

(10) Patent No.: US 10,343,426 B2
(45) Date of Patent: Jul. 9, 2019

(54) PRINTING APPARATUS THAT CONTROLS A POSITION OF A DISCHARGE TRAY, AND RELATED CONTROL METHOD AND NON-TRANSITORY COMPUTER-READABLE MEDIUM

(71) Applicant: CANON KABUSHIKI KAISHA, Tokyo (JP)

(72) Inventor: Kazuhisa Fujino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/630,001

(22) Filed: Jun. 22, 2017

(65) Prior Publication Data

US 2018/0029387 A1 Feb. 1, 2018

(30) Foreign Application Priority Data

Jul. 29, 2016 (JP) ..... 2016-150554

(51) Int. Cl.
*B41J 13/00* (2006.01)
*B41J 13/10* (2006.01)
(Continued)

(52) U.S. Cl.
CPC ..... *B41J 13/0009* (2013.01); *B41J 13/106* (2013.01); *B65H 31/02* (2013.01);
(Continued)

(58) Field of Classification Search
CPC ..... B41J 13/0036; B41J 13/009; B41J 13/00; B65H 2511/51; B65H 2511/515; B65H 2513/512
See application file for complete search history.

(56) References Cited

U.S. PATENT DOCUMENTS 5,253,029 A * 10/1993 Kang ..... B65H 7/04 271/258.01
7,073,880 B2 7/2006 Takahashi et al.
(Continued)

FOREIGN PATENT DOCUMENTS

JP 61-173183 U 10/1986
JP 2004-090460 A 3/2004
(Continued)

OTHER PUBLICATIONS

Office Action dated Mar. 29, 2019, issued in Japanese Patent Application No. 2016-150554.

*Primary Examiner* — Sharon A. Polk
(74) *Attorney, Agent, or Firm* — Venable LLP

(57) ABSTRACT

A printing apparatus includes a printing unit that prints on a printing medium, and a discharge tray that is movable, by a motor, between an accommodated position and an extended position. An external tray is detachably attached to the printing apparatus. An operation unit displays a screen on a display screen to receive a moving instruction for moving the discharge tray, and confirmation of removal of the printing medium from the discharge tray. When the operation unit receives a moving instruction for moving the discharge tray from the extended position to the accommodated position, a control unit moves the discharge tray after receiving confirmation from a user, via the screen, that the printing medium has been removed from the discharge tray, and, when the external tray is attached to the printing apparatus, the control unit does not move the discharge tray from the accommodated position to the extended position.

20 Claims, 10 Drawing Sheets

(51) Int. Cl.
*B65H 31/02* (2006.01)
*B65H 31/22* (2006.01)
*B65H 43/02* (2006.01)

(52) U.S. Cl.
CPC ..... *B65H 31/22* (2013.01); *B65H 43/02* (2013.01); *B65H 2301/4212* (2013.01); *B65H 2402/46* (2013.01); *B65H 2405/12* (2013.01); *B65H 2405/324* (2013.01); *B65H 2511/20* (2013.01); *B65H 2511/515* (2013.01); *B65H 2551/20* (2013.01)

(56) References Cited

U.S. PATENT DOCUMENTS

| | | | | |
|---|---|---|---|---|
| 8,340,567 | B2 | 12/2012 | Katayama | |
| 9,187,279 | B2 | 11/2015 | Nunokawa et al. | |
| 2010/0061787 | A1* | 3/2010 | Katayama | B41J 3/4073<br>399/405 |
| 2014/0035218 | A1* | 2/2014 | Koyama | B65H 31/20<br>271/3.14 |

FOREIGN PATENT DOCUMENTS

| | | | |
|---|---|---|---|
| JP | 2006-327802 | A | 12/2006 |
| JP | 2010-058460 | A | 3/2010 |
| JP | 2015-027901 | A | 2/2015 |

* cited by examiner

PRINTING APPARATUS THAT CONTROLS A POSITION OF A DISCHARGE TRAY, AND RELATED CONTROL METHOD AND NON-TRANSITORY COMPUTER-READABLE MEDIUM

This application claims the benefit of Japanese Patent Application No. 2016-150554, filed Jul. 29, 2016, which is hereby incorporated by reference herein in its entirety.

BACKGROUND OF THE INVENTION

Field of the Invention

The present invention relates to a printing apparatus, a control method thereof, and a non-transitory computer-readable medium.

Description of the Related Art

A printing apparatus includes a discharge tray for receiving a discharged and printed printing medium. If the discharge tray is in a state capable of receiving the printing medium (to be referred to as an extended state hereafter), the installation area of the printing apparatus itself becomes large. Therefore, the installation area of the printing apparatus is generally kept narrow when not in use by accommodating the discharge tray in a main body (to be referred to as an accommodated state hereafter) when not in use. A method of changing the discharge tray from the extended state to the accommodated state includes a method of accommodating the discharge tray manually by a user and a method of accommodating the discharge tray automatically by the printing apparatus.

The printing medium on the discharge tray is drawn into the printing apparatus main body simultaneously with the change of the discharge tray to the accommodated state. This creates a problem when the printing apparatus accommodates the discharge tray automatically. In order to solve this problem, for example, Japanese Patent Laid-Open No. 2006-327802 discloses a technique of putting a cover on a discharging port before accommodating the discharge tray.

That is, the method disclosed in Japanese Patent Laid-Open No. 2006-327802 needs a cover member for closing the discharging port of the printing medium. This may lead to increases in cost and size of the printing apparatus. Even though the discharging port is closed with the cover, if the printing medium is stacked on the discharge tray, the printing medium may drop when the discharge tray changes to the accommodated state.

SUMMARY OF THE INVENTION

The present invention has been made in consideration of the above-described problems and can control, without needing an additional member, accommodation of a discharge tray so as not to draw a printing medium into a printing apparatus main body.

According to one aspect, the present invention provides a printing apparatus comprising a printing unit configured to print on a printing medium, a discharge tray to which the printing medium printed by the printing unit is discharged, a control unit configured to control the discharge tray to be accommodated in the apparatus and to be extended from the apparatus, and a storage unit configured to set and store first information for controlling the discharge tray in accordance with an operation performed by the apparatus, wherein, if the first information indicates an effect that accommodation of the discharge tray is inhibited, the control unit does not accommodate the discharge tray in the apparatus.

According to another aspect, the present invention provides a method of controlling a printing apparatus that includes a printing unit configured to print on a printing medium and a discharge tray to which the printing medium printed by the printing unit is discharged, the method comprising controlling the discharge tray to be accommodated in the printing apparatus and to be extended from the printing apparatus, and setting and storing, by a storage unit, first information for controlling the discharge tray in accordance with an operation performed by the printing apparatus, wherein, if the first information indicates an effect that accommodation of the discharge tray is inhibited, the discharge tray is not accommodated in the printing apparatus in the controlling.

According to yet another aspect, the present invention provides a non-transitory computer-readable medium that causes a computer to function as a control unit configured to control accommodation and extension of a discharge tray to which a printing medium printed by a printing unit is discharged, and a storage unit configured to set and to store first information for controlling the discharge tray in accordance with an operation performed by the computer, wherein, if the first information indicates an effect that accommodation of the discharge tray is inhibited, the control unit stores a program that does not accommodate the discharge tray.

The present invention can control, without needing an additional member, accommodation of a discharge tray so as not to draw a printing medium into a printing apparatus main body.

Further features of the present invention will become apparent from the following description of exemplary embodiments (with reference to the attached drawings).

BRIEF DESCRIPTION OF THE DRAWINGS

FIG. 4 is an operation flowchart when the power is turned on.

DESCRIPTION OF THE EMBODIMENTS

First Embodiment

An embodiment of the present invention will be described with reference to the accompanying drawings. Note that an arrangement to be described below is an example, and the present invention is not limited to this arrangement.

Outer Appearance of Apparatus

Figure 1A:
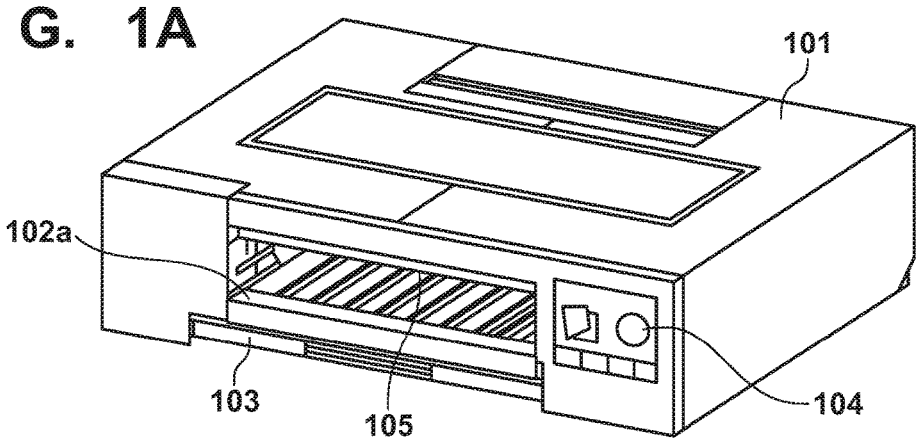
FIGS. 1A, 1B, and 1C are views each showing the schematic arrangement of a printing apparatus according to the present invention.
Figure 1B:
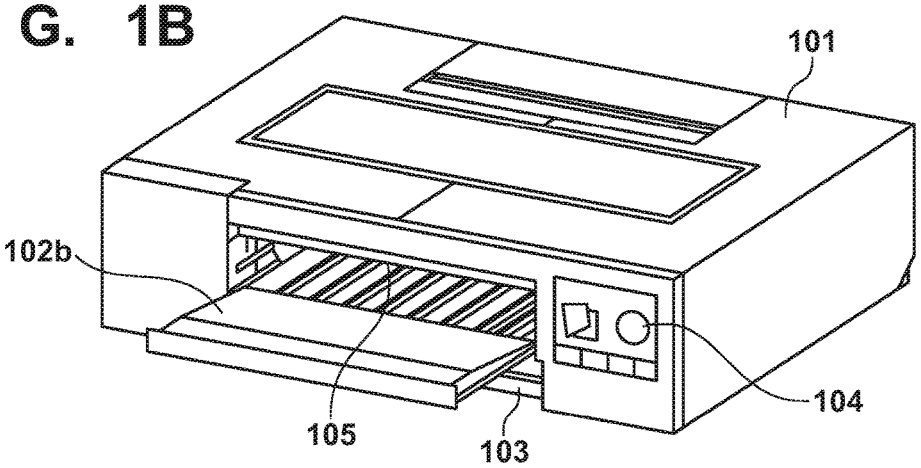
Figure 1C:
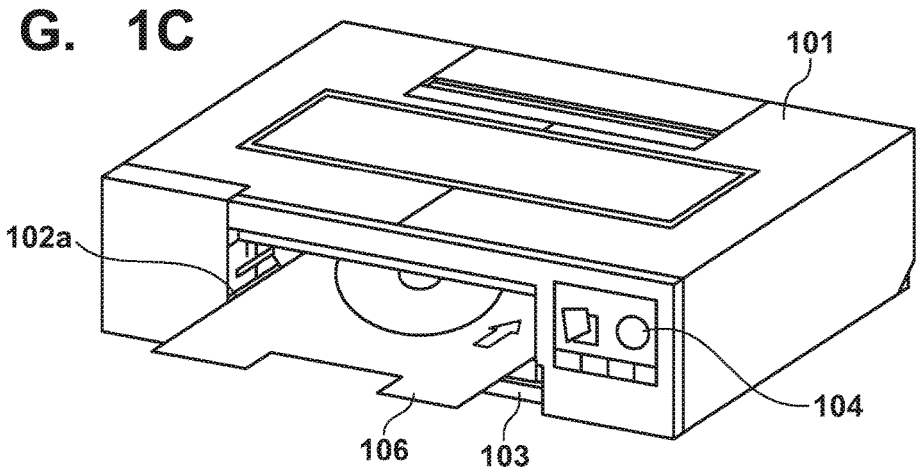

Each of FIGS. 1A, 1B, and 1C shows the schematic arrangement of an inkjet printing apparatus (printing apparatus) 101 and the state of a discharge tray 102 according to this embodiment. The printing apparatus 101 feeds printing media, such as sheets, one by one from a stackable feed port 103. The printing apparatus 101 includes a printing unit with a printhead that performs a printing operation of discharging ink and printing an image on a printing medium fed inside the printing apparatus 101. The printing apparatus 101 discharges the printing medium onto the discharge tray 102 after printing on the printing medium by the printhead. The printing apparatus 101 also includes an operation unit 104 capable of receiving an operation from a user and notifying the user of information. In this embodiment, the arrangement is shown in which the printing apparatus 101 includes the feed port 103 capable of stacking the printing medium. The printing apparatus 101 may further include, however, a feed port capable of manual feeding.

Figure 10:
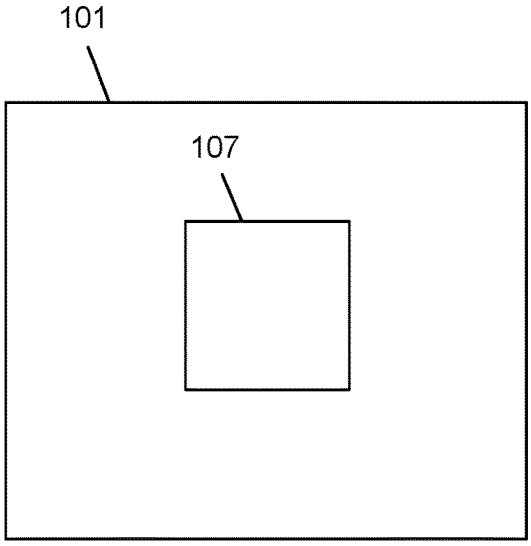
FIG. 10 is a view showing a schematic arrangement of a motor of the printing apparatus.

The printing apparatus 101 can maintain a small installation area by changing a state of the discharge tray 102 to an accommodated state 102*a* (FIG. 1A), in which the discharge tray 102 is accommodated in a main body of the printing apparatus 101 when not in use (when the printing operation is not performed). The printing apparatus 101 is changed to an extended state 102*b* (FIG. 1B) capable of stacking printed printing medium when in use (when the printing operation is performed). The printing apparatus 101 changes the discharge tray 102 from the accommodated state 102*a* to the extended state 102*b* and from the extended state 102*b* to the accommodated state 102*a* by operating an internal motor 107 (shown in FIG. 10) and a roller (not shown). In this embodiment, a description will be given by taking, as an example, a discharge tray that performs extension/accommodation by sliding. The present invention is not limited, however, to this arrangement. A cover-type discharge tray that performs extension/accommodation by pivoting may be used.

In addition, the printing apparatus 101 detachably includes a disk tray 106 serving as an external tray, as shown in FIG. 1C. When the disk tray 106 is installed, it is possible, by placing a disk, such as a digital versatile disc (DVD) or a compact disc (CD) on the disk tray 106, to print on the disk (to be referred to as disk printing). Note that, in the printing apparatus 101 according to this embodiment, both the disk tray 106 and the discharge tray 102 are provided at the position of a discharging port 105, making it impossible to operate them simultaneously. That is, at the time of disk printing, the discharge tray 102 is set in the accommodated state, as shown in FIG. 1A. When disk printing is performed, the disk tray 106 is accommodated in the printing apparatus 101 as indicated by an arrow in FIG. 1C.

Hardware Arrangement

Figure 2:
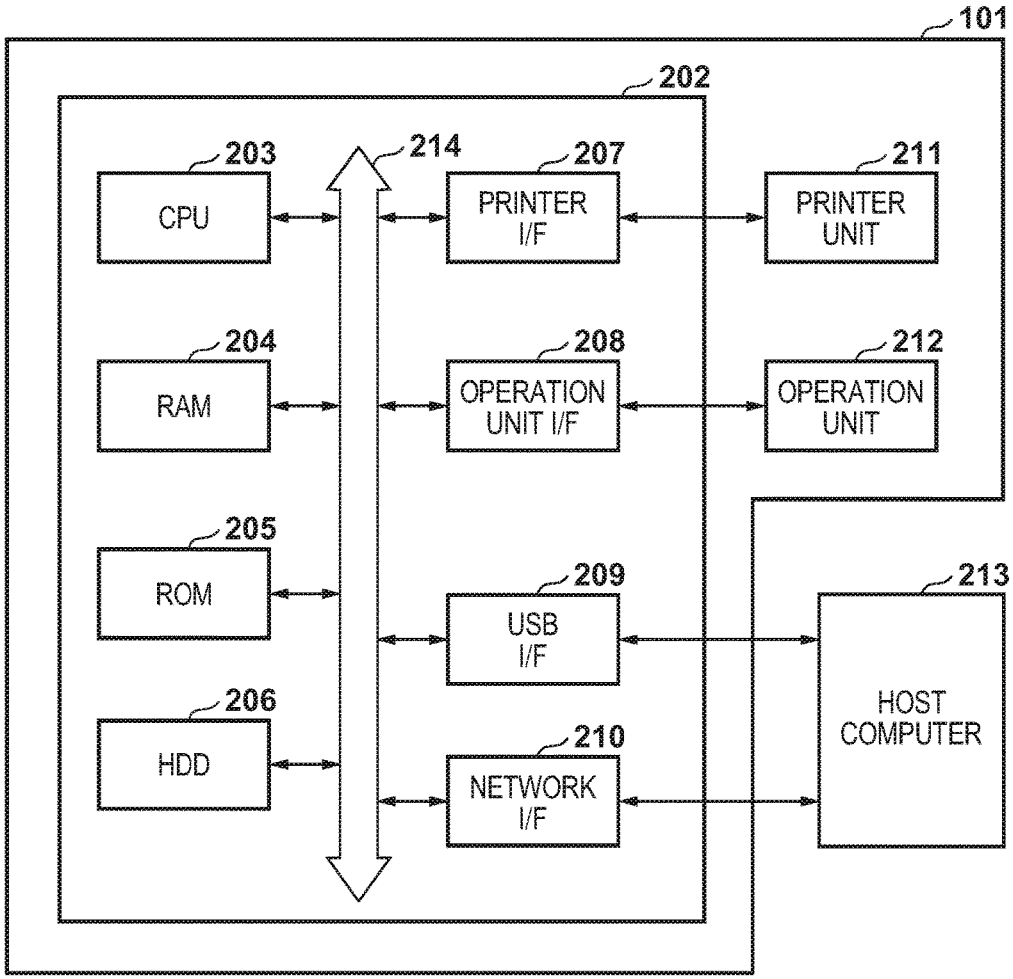
FIG. 2 is a block diagram showing an example of the hardware arrangement of the printing apparatus.

FIG. 2 is a block diagram showing an example of the hardware arrangement of the printing apparatus 101 according to this embodiment. The printing apparatus 101 includes a control unit 202, a printer unit 211, and an operation unit 212. The control unit 202 includes a-central processing unit (CPU) 203, a random-access memory (RAM) 204, a read only memory (ROM) 205, a hard disk drive (HDD) 206, a printer interface (I/F) 207, an operation unit I/F 208, a universal serial bus (USB) I/F 209, and a network I/F 210. The respective constituent elements are communicably connected to each other via a system bus 214. The CPU 203 performs various types of control, such as power-on control and printing control, by loading control programs recorded in the ROM 205 and the HDD 206 to the RAM 204, and reading and executing these control programs. The RAM 204 is a main memory, and is used as a temporary storage area for various programs stored in a work area and the ROM 205 to be loaded. The ROM 205 is a non-volatile storage area, and stores image data, various programs, and various types of setting information. For example, a flash storage, or the like, corresponds to the ROM 205. The HDD 206 is a non-volatile auxiliary storage device, and stores various programs and data.

Note that, in the printing apparatus 101 according to this embodiment, one CPU 203 uses one memory to perform respective processes shown in flowcharts to be described later. Another mode may, however, be used. An arrangement may be adopted in which, for example, a plurality of CPUs, a plurality of RAMs, ROMs, and HDDs cooperate with each other. Further, the present invention is not limited to an arrangement by software based on a program. Some of the processes may be performed by using a hardware circuit.

The printer I/F (interface) 207 connects the printer unit 211 and the control unit 202, and controls communication between the printer unit 211 and the control unit 202. Image data to be printed by the printer unit 211 is transferred from the control unit 202 via the printer I/F 207 and is printed on a printing medium in the printer unit 211. The printer unit 211 is a printing mechanism that performs the printing operation, and includes a part which portion that performs image formation and a portion that conveys the printing medium.

The operation unit I/F 208 connects the operation unit 212 and the control unit 202, and controls communication between the operation unit 212 and the control unit 202. The operation unit 212 includes a display unit having a touch panel function, an operation key, and the like, and functions as a reception unit that receives a user instruction. This display unit and the operation key correspond to the operation unit 104 in each of FIGS. 1A to 1C. Each of the USB I/F 209 and the network I/F 210 is an interface that communicably connects the printing apparatus 101 to an external apparatus. Here, a host computer 213, such as a personal computer (PC), is shown as the external apparatus.

Software Arrangement

Figure 3:
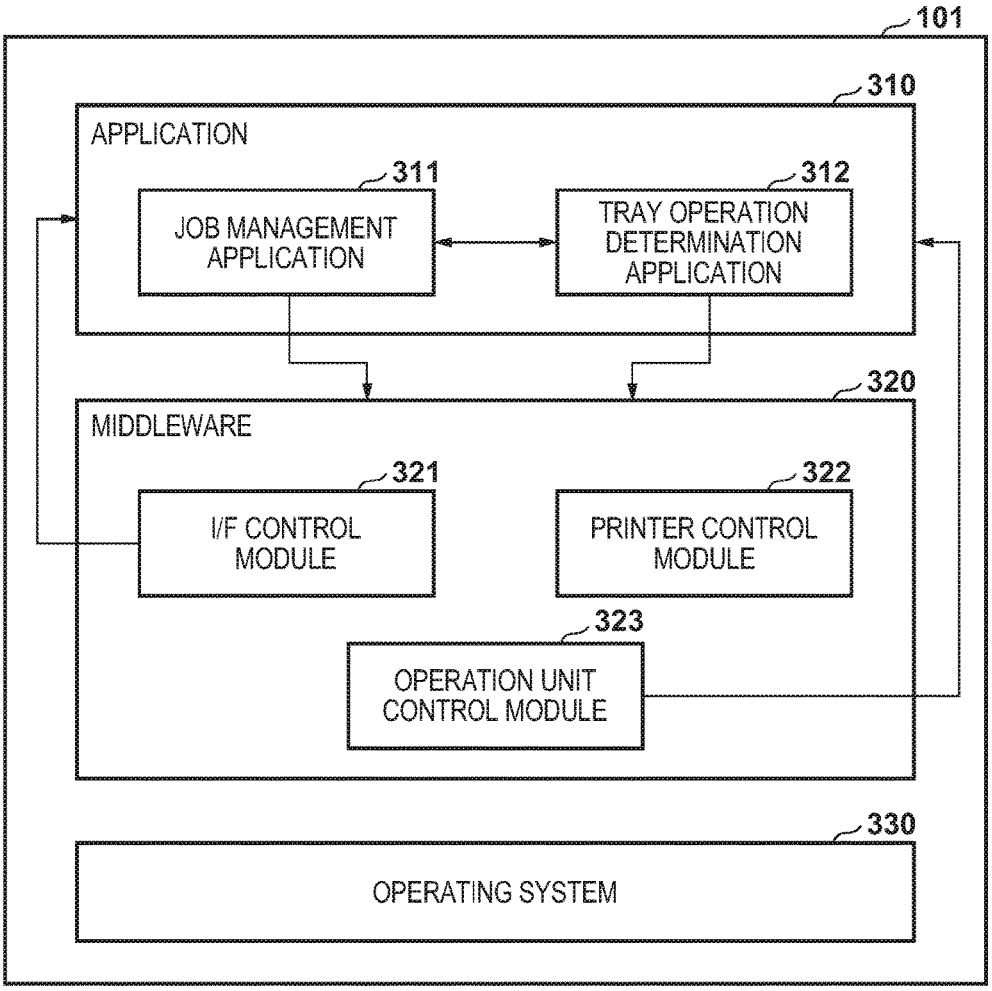
FIG. 3 is a block diagram showing an example of the software arrangement of the printing apparatus.

FIG. 3 is a block diagram showing an example of the software arrangement according to this embodiment. Control programs as software are divided into three layers of an application layer 310, a middleware layer 320, and an operation system 330. The middleware layer 320 is made of a software (middleware) group that controls an I/F with the printer unit or each physical device for controlling the apparatus via various I/Fs. In this embodiment, the middleware layer 320 includes a printer control module 322 as a module that controls the printer I/F 207. Similarly, the middleware layer 320 includes an operation unit control module 323 that controls the various I/Fs shown in FIG. 2. The operation system 330 controls the entire printing apparatus 101. The operation system 330 provides a basic function of executing the control programs by the control unit 202.

The application layer 310 includes various applications of the printing apparatus 101, and the printing apparatus 101 implements a function, such as printing, provided to a user by operating each device via each middleware. In this embodiment, the application layer 310 includes, as an example, a job management application 311 and a tray operation determination application 312. For example, if the operation unit control module 323 serving as the middleware receives an instruction to print from the user via the operation unit 212 and the operation unit I/F 208, the application layer 310 is notified of that instruction. In the application layer 310, the job management application 311 controls, based on the received instruction, job management and printing execution. The job management application 311 uses the printer control module 322 serving as the middleware to perform the printing operation by the printer unit 211.

Further, if the operation unit control module 323 receives an instruction to power off the printing apparatus 101 via the operation unit 212, the tray operation determination application 312 is notified of this instruction. The tray operation determination application 312 confirms the state of the printing apparatus 101 via the execution result of the print job or the printer control module 322. The tray operation determination application 312 displays various screens in the operation unit 212 via the operation unit control module 323, as needed. For example, by displaying a screen 901 shown in FIG. 9A in the operation unit 212, the user receives an instruction to remove the printing medium on the discharge tray 102. Subsequently, based on an instruction to accommodate the discharge tray 102 from the user via the screen 901, the tray operation determination application 312 accommodates the discharge tray 102 in the main body of the printing apparatus 101 via the printer control module 322 (FIG. 1A). Note that this operation will be described in detail later with reference to the flowchart.

Processing Sequence

The operation flowchart of the printing apparatus 101 according to this embodiment will be described below. In this embodiment, a discharge guarantee flag and a disk tray undetachment flag are used.

The discharge guarantee flag indicates whether to guarantee that discharge is performed completely. A case in which discharge is performed completely here means that, in that state, the printing medium may not be caught when the discharge tray 102 is accommodated in the main body. In other words, a state in which discharge is not guaranteed indicates a state in which, for example, a discharge operation according to the type of printing medium cannot be performed, resulting in the trailing end of the printing medium being not discharged from the printing apparatus 101 completely. Therefore, in a situation in which the printed printing medium is not discharged outside the printing apparatus 101 completely, the printing medium may be drawn into the main body of the printing apparatus 101 from the discharging port 105 along with an operation of drawing the discharge tray 102 (accommodation operation). Therefore, in this embodiment, control is performed so as to inhibit accommodation of the discharge tray 102 when the value of the discharge guarantee flag is OFF.

The disk tray undetachment flag indicates whether the disk tray 106 attached at the time of disk printing is not detached. In this embodiment, control is performed so as to inhibit extension of the discharge tray 102 when the value of the disk tray undetachment flag is ON.

Note that information on each flag is stored in the non-volatile storage area so as not to be deleted by the power discontinuity or the like of the printing apparatus 101. If the information is stored in a volatile storage area, it should be initialized to a value that inhibits an operation before referring to each flag. The update of and reference to each flag will be described in detail together with the process.

Upon Power-On

Figure 4:
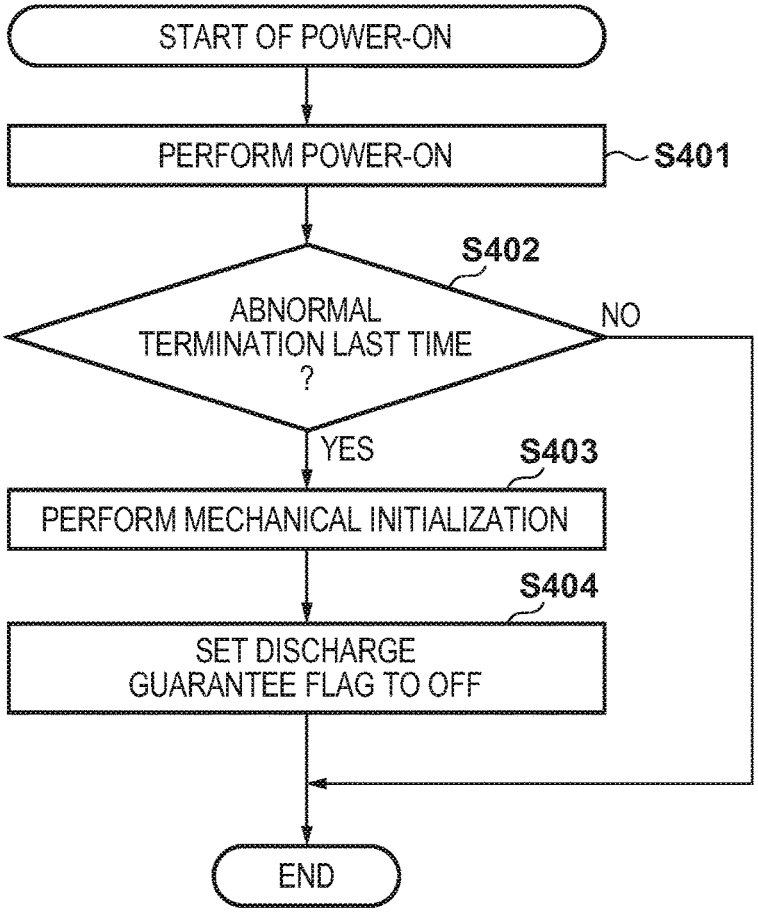

FIG. 4 shows the flowchart when the printing apparatus 101 is powered on according to this embodiment. The respective arrangements shown in FIG. 3 control this operation sequence.

In step S401, the printing apparatus 101 performs a power-on process. More specifically, the CPU 203 loads the various programs stored in the ROM 205 onto the RAM 204 and initializes primary storage information used to control the printing apparatus 101. At this time, information on the values of the discharge guarantee flag and the disk tray undetachment flag stored in the non-volatile storage area is maintained without being initialized.

In step S402, the printing apparatus 101 determines whether there was an abnormal termination at the time of last power-off. The abnormal termination includes, for example, a case in which the power is turned off by a power failure or plugging/unplugging without performing a normal power-off operation, a case in which the power is turned off when the printing apparatus 101 is in an error state, or the like. In a state in which there was the abnormal termination last time, the printing medium may remain in the printing apparatus 101 other than the feed port 103. If the printing apparatus 101 determines that there was the abnormal termination (YES in step S402), the process advances to step S403. If the printing apparatus 101 determines that there was not the abnormal termination (NO in step S402), this processing sequence ends.

In step S403, the printer control module 322 controls the printer unit 211 to perform mechanical initialization. In the mechanical initialization, an initialization operation of restoring the printer unit 211 to a normal state regardless of a state before the abnormal termination is performed. At this time, low-speed discharge is generally performed such that all printing media in the printer unit 211 or on the conveyance path of the printing media can be discharged. In this case, the printing medium cannot be discharged quickly in the low-speed discharge, bringing about a state in which the printing medium cannot be discharged outside the printing apparatus 101 completely, such as a state in which the trailing end of the printing medium remains caught on a discharge roller (not shown). In the present invention, the process of step S404 is performed in order to manage a state incapable of guaranteeing discharge as described above.

In step S404, the tray operation determination application 312 sets the discharge guarantee flag to OFF. Then, this processing sequence ends.

Note that in FIG. 4, a description has been given by taking, as an example, the mechanical initialization when the power is turned on. Other than the power-on, however, the discharge guarantee flag is also set to OFF when the printing medium is discharged by the mechanical initialization. This indicates that reliable discharge cannot be guaranteed at the time of the mechanical initialization. In other words, by performing the mechanical initialization, the possibility of drawing of the printing medium if the discharge tray 102 is accommodated in the main body at that time is managed.

Upon Printing

Figure 5:
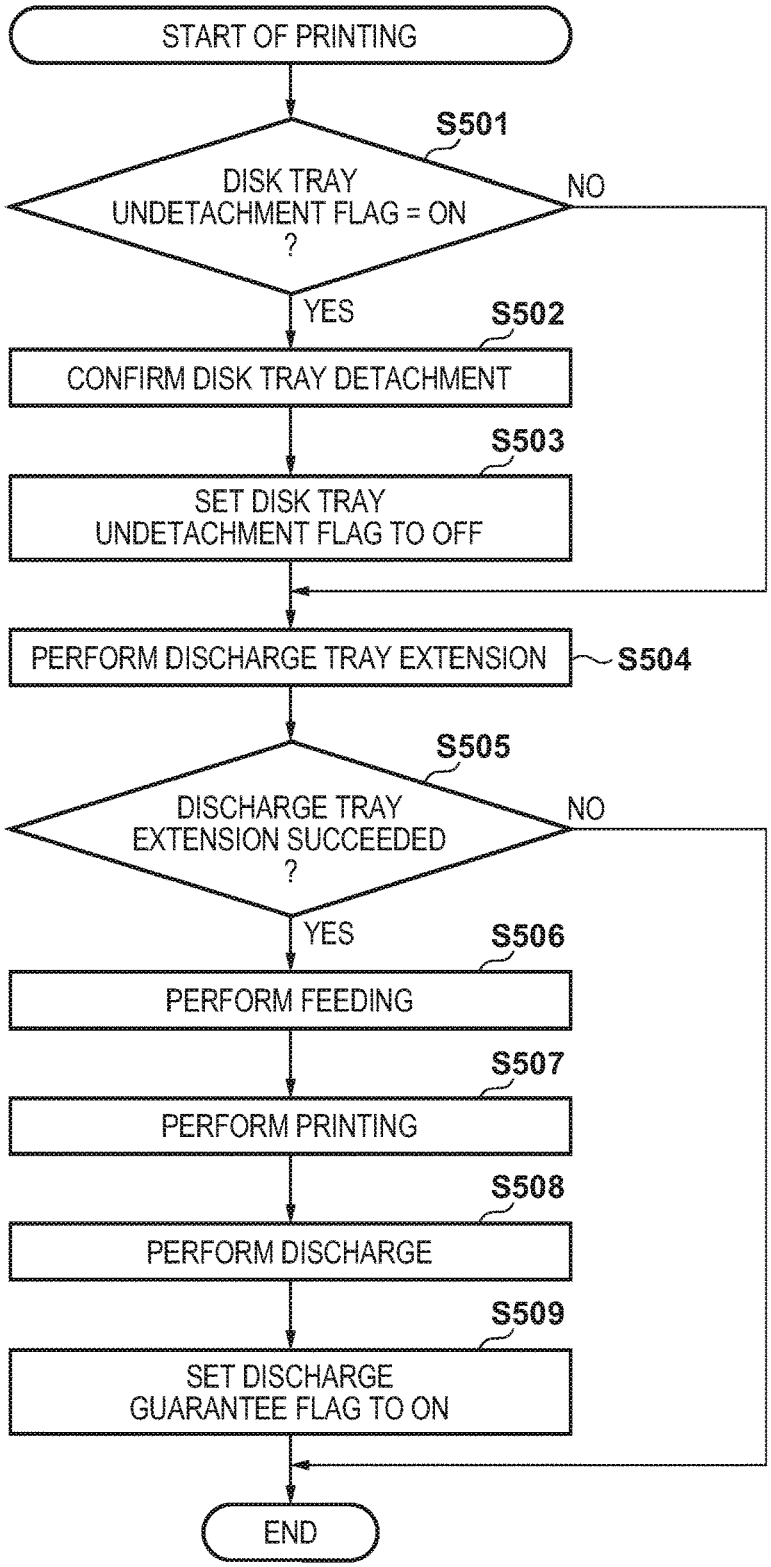
FIG. 5 is an operation flowchart when printing is performed from a feed port.

FIG. 5 shows the flowchart when printing is performed on the printing medium fed from the feed port 103. The respective arrangements shown in FIG. 3 control this operation sequence.

In step S501, the tray operation determination application 312 determines whether the disk tray undetachment flag is ON in order to confirm that the user detaches the disk tray 106 from the discharging port 105. A state in which the disk tray 106 is not detached refers to a state in which, in a disk printing operation to be described later with reference to FIG. 7, although the disk tray 106 is discharged after printing using the disk tray 106, the user does not detach it from the printing apparatus 101 (state in FIG. 1C). The disk tray undetachment flag is set to ON in a situation in which the disk tray 106 is not detached, and is set to OFF in a situation in which the disk tray 106 is attached. If the disk tray undetachment flag is ON (YES in step S501), the process advances to step S502. If the disk tray undetachment flag is OFF (NO in step S501), the process advances to step S504.

In step S502, the operation unit control module 323 notifies, via the operation unit 212, the user that the disk tray 106 is not detached and instructs the user to detach the disk tray 106. As exemplified in FIG. 1C, in the printing apparatus 101 with the discharging port 105 and the insertion port of the disk tray 106 being the same, the discharge tray 102 and the disk tray 106 interfere with each other if the discharge tray 102 is extended in a state in which the disk tray 106 is inserted in the main body. As a result, the disk tray 106 may drop from the main body when the discharge tray 102 is extended. To cope with this, the user detaches the disk tray 106, preventing the disk tray 106 from dropping from the main body.

In step S503, the tray operation determination application 312 changes the disk tray undetachment flag to OFF after confirming that the disk tray 106 is detached. As a means for confirming that the disk tray 106 is detached, this may be confirmed with the user via the operation unit 212 or, if the printing apparatus 101 includes a sensor that detects the detachment state of the disk tray 106, this sensor may be used for the detection.

In step S504, the printer control module 322 controls the printer unit 211 to change the discharge tray 102 from the accommodated state 102*a* to the extended state 102*b*. This brings about a state in which a printing medium discharged from the discharging port 105 after printing can be stacked on the discharge tray 102.

In step S505, the tray operation determination application 312 determines whether extension of the discharge tray 102 succeeds via the printer control module 322. If extension of the discharge tray 102 succeeds (YES in step S505), the process advances to step S506. If extension of the discharge tray 102 fails (NO in step S505), the job management application 311 displays an error in the operation unit 212, or the like, without performing the printing operation, terminating printing processing. Note that, as a concrete cause of a failure to extend the discharge tray, for example, a case incapable of extending the discharge tray 102 physically because an obstacle is placed in an extension direction is given. Thus, if extension of the discharge tray 102 fails, the operation unit control module 323 may prompt re-execution of printing after causing, via the operation unit 212, the user to remove the obstacle in the extension direction of the discharge tray 102. It is possible, by a determination in step S505, to prevent a situation in which the discharge tray 102 is discharged in an unextended state, and the printed printing medium drops.

In step S506, the printer control module 322 controls the printer unit 211 to feed the printing medium from the feed port 103.

In step S507, the printer unit 211 prints on the fed printing medium.

In step S508, the printer control module 322 discharges the printed printing medium onto the discharge tray 102. In a case in which the printing operation is performed here, and the discharge is completed normally, the possibility of drawing of the printing medium is low even if the discharge tray 102 is accommodated in the main body at that time, unlike the above-described mechanical initialization.

In step S509, the printer control module 322 sets the discharge guarantee flag to ON. Then, this processing sequence ends.

Upon Discharge Tray Accommodation

Figure 6:
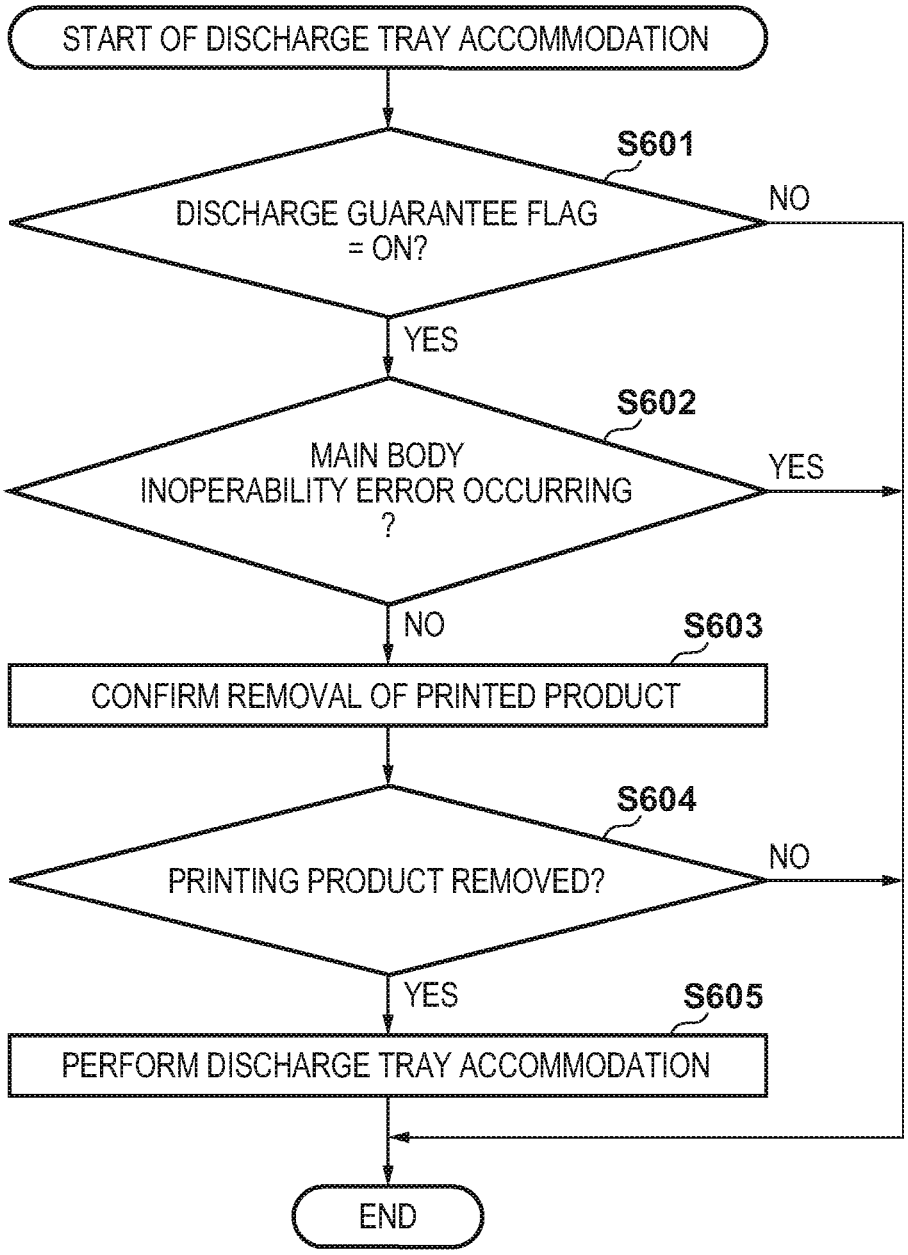
FIG. 6 is an operation flowchart when a discharge tray is accommodated.

FIG. 6 shows the flowchart when the printing apparatus 101 changes the discharge tray 102 from the extended state 102*b* to the accommodated state 102*a*.

In step S601, the tray operation determination application 312 determines whether the discharge guarantee flag is ON. If the discharge guarantee flag is OFF here, it indicates a state in which discharge is not guaranteed. If the discharge guarantee flag is ON (YES in step S601), the process advances to step S602. On the other hand, if the discharge guarantee flag is OFF (NO in step S601), this processing sequence ends without accommodating the discharge tray 102. That is, it is possible, without accommodating the discharge tray 102 forcibly, depending on the value of the discharge guarantee flag, to avoid damage inside the printing apparatus 101 and to the printing medium.

In step S602, the tray operation determination application 312 inquires of the printer control module 322 whether the printer unit 211 is in an inoperable state because of an error, or the like. If the tray operation determination application 312 determines that the printer unit 211 is in the inoperable state (YES in step S602), this processing sequence ends without accommodating the discharge tray 102. If the tray operation determination application 312 determines that the printer unit 211 is in an operable state (NO in step S602), the process advances to step S603. Note that a main body inoperability error is not particularly limited. For example, running out of ink, a malfunction in each mechanism, or the like, can be given as the error.

Figure 9A:
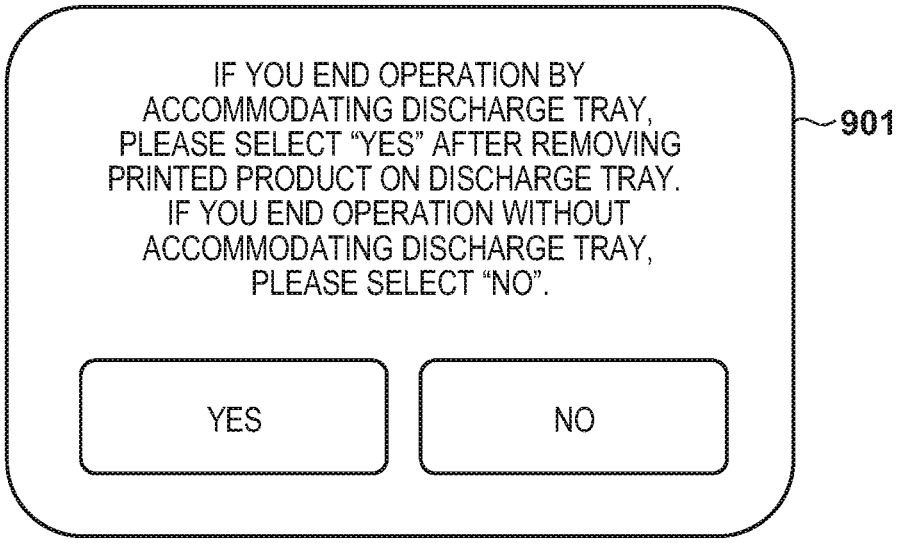
FIGS. 9A and 9B are views each showing an example of a screen arrangement according to the present invention.

In step S603, the operation unit control module 323 displays the screen 901 shown in FIG. 9A via the operation unit 212 and confirms with the user that the printing medium is removed from the discharge tray 102. This is because the printing medium may drop from the upper part of the discharge tray 102 if the discharge tray 102 is accommodated when the printing medium is stacked on the discharge tray 102, even though the printer unit 211 is in an operable condition.

In step S604, the tray operation determination application 312 confirms an operation from the user for the screen 901 displayed in step S603 and determines whether the printing medium is removed from the discharge tray 102. If the printing medium is not removed from the upper part of the discharge tray 102 (NO in step S604), the printing medium on the discharge tray 102 may drop, and thus, this processing sequence ends without accommodating the discharge tray 102. On the other hand, if the printing medium is removed from the upper part of the discharge tray 102 (YES in step S604), the process advances to step S605.

In step S605, the printer control module 322 controls the printer unit 211 to accommodate the discharge tray 102 in the main body of the printing apparatus 101 (accommodated state 102*a*). Then, this processing sequence ends.

Upon Disk Printing

Figure 7:
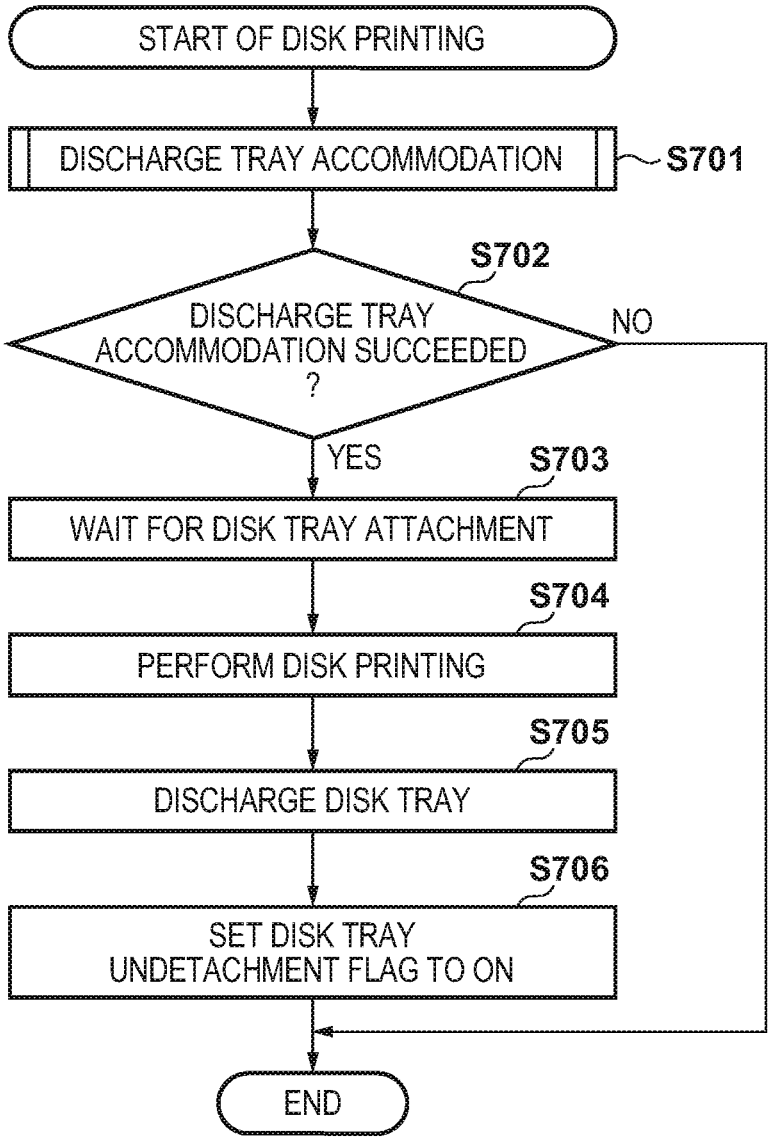
FIG. 7 is an operation flowchart when disk printing is performed.

FIG. 7 shows the flowchart when disk printing is performed as an example of a timing at which the discharge tray 102 is accommodated. In disk printing, the discharge tray 102 is accommodated in the main body of the printing apparatus 101 (accommodated state 102*a*) as shown in FIG. 1C, and then the disk tray 106 is further attached to the discharging port 105. Then, the attached disk tray 106 is drawn into the main body of the printing apparatus 101 for printing on a disk media on the disk tray 106. When disk printing is performed, for example, an instruction to perform disk printing is received from the user via the operation unit 212. The initial value of the disk tray undetachment flag when disk printing is performed is set to OFF. Note that a description is given by taking the disk tray 106 compatible with disk printing as an example here. The present invention is not limited, however, to this arrangement as long as an external tray compatible with other printing is used.

In step S701, the tray operation determination application 312 performs a process of accommodating the discharge tray shown in FIG. 6 and accommodates the discharge tray 102 in the main body of the printing apparatus 101. At this time, the disk tray 106 is not attached to the printing apparatus 101.

In step S702, the tray operation determination application 312 determines whether the discharge tray 102 can be accommodated. As a cause of a failure in accommodating the discharge tray 102, for example, a case in which the discharge tray 102 is held by the user and cannot be drawn physically is given, in addition to the contents described with reference to FIG. 6. If the discharge tray 102 cannot be accommodated and is not set in the accommodated state 102*a* (NO in step S702), the disk tray 106 cannot be attached into the printing apparatus 101, and thus, this processing sequence ends without performing disk printing. At this time, an error, or the like, may be displayed in the operation unit 212 or the like. If the discharge tray 102 can be accommodated (YES in step S702), the process advances to step S703.

In step S703, the operation unit control module 323 prompts the user to attach the disk tray 106 by displaying a screen, or the like, in the operation unit 212. Then, the printing apparatus 101 waits until the user attaches the disk tray 106.

After the user attaches the disk tray 106 to the printing apparatus 101, in step S704, the printer control module 322 controls the printer unit 211 to print on the disk media on the disk tray 106.

After disk printing ends, in step S705, the printer control module 322 discharges the disk tray 106 (state in FIG. 1C).

In step S706, the tray operation determination application 312 sets the disk tray undetachment flag to ON. With this setting, the disk tray 106 is prevented from dropping by restricting extension of the discharge tray 102 in the process in step S501 of FIG. 5. Subsequently, the operation unit control module 323 notifies the user of the end of disk printing via the operation unit 212. At this time, if it can be confirmed that the user detaches the disk tray 106, the disk tray undetachment flag may be set to OFF. As a means for detecting that the user detaches the disk tray 106, a user operation via the operation unit 212 may be used or, if the printing apparatus 101 mounts the sensor that detects the detachment state of the disk tray 106, this sensor may be used for the detection. Then, this processing sequence ends.

Upon Power-Off

Figure 8:
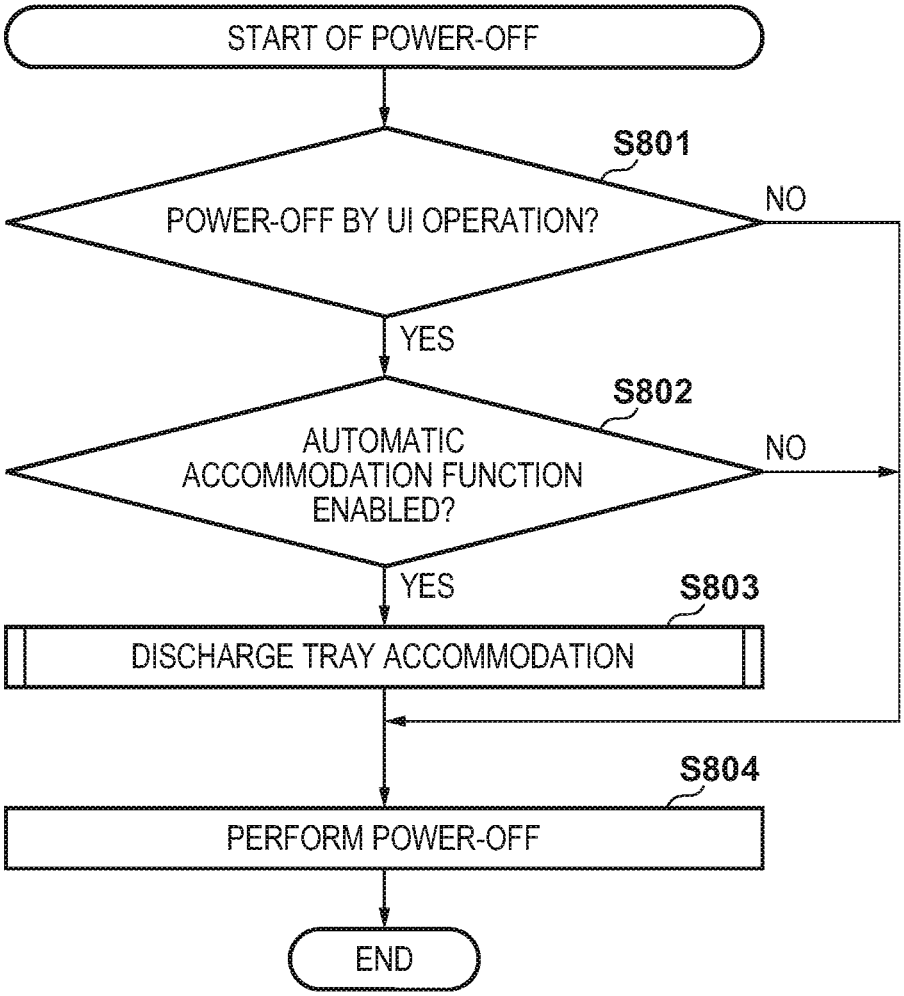
FIG. 8 is an operation flowchart when the power is turned off.

FIG. 8 shows the flowchart when the printing apparatus 101 is powered off. The user does not use the printing apparatus 101 after power-off, changing the discharge tray 102 to the accommodated state 102*a*.

In step S801, the tray operation determination application 312 confirms whether a power-off command is input by the operation of the operation unit 104. As a concrete example of a case in which the command is not input by the operation of the operation unit 104, for example, a case in which the user gives an instruction to power off the printing apparatus 101 from the host computer 213 serving as the external apparatus is given. In this case, it is considered that the user is not present around the printing apparatus 101, making it impossible for the user to confirm whether the printing medium on the discharge tray 102 is removed. If the power-off command is given by the operation of the operation unit 104 (YES in step S801), the process advances to step S802. Otherwise (NO in step S801), the process advances to step S804 without accommodating the discharge tray 102.

Figure 9B:
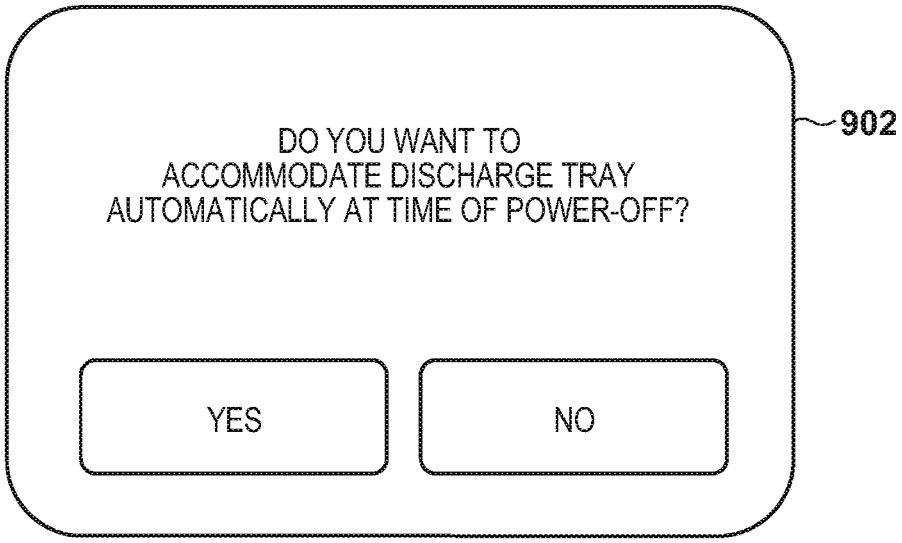

In step S802, the tray operation determination application 312 confirms whether an automatic accommodation function in user setting information is enabled. In this embodiment, the user can enable/disable the automatic accommodation function. More specifically, as the user setting of the automatic accommodation function, the operation unit control module 323 displays a screen 902 of FIG. 9B in the operation unit 104. Then, on the screen 902, the automatic accommodation function at the time of power-off is enabled if the user selects "Yes", and the automatic accommodation function at the time of power-off is disabled if the user selects "No". If the function is not enabled (that is, disabled) (NO in step S802), the process advances to step S804 without accommodating the discharge tray 102. If the function is enabled (YES in step S802), the process advances to step S803.

In step S803, the tray operation determination application 312 performs the process of accommodating the discharge tray shown in FIG. 6.

In step S804, the operation system 330 powers off the printing apparatus 101. Here, the printer control module 322 controls the printer unit 211 to change to a state capable of keeping the printing apparatus 101 left still for a long time. As a concrete example, a cap operation is performed so as not to dry a nozzle that discharges ink. For example, control for minimizing the standby power of the printing apparatus 101 is also performed.

Note that the power can be turned off even if the accommodation operation of the discharge tray 102 fails in step S803. Thus, it may not be confirmed whether to succeed in accommodating the discharge tray.

As described above, the discharge guarantee flag is set to OFF at a timing when a printing medium may be drawn into the main body when the discharge tray 102 is accommodated, and accommodation of the discharge tray 102 is not performed. This makes it possible, in this embodiment, to prevent drawing of the printing medium as the discharge tray 102 is accommodated in the main body of the printing apparatus 101.

Second Embodiment

An embodiment will be described in which a timing in changing the setting of each flag described in the first embodiment is changed.

In the first embodiment, the discharge guarantee flag is set to OFF in step S404 after the printing medium is discharged by the mechanical initialization in step S403 of FIG. 4. On the other hand, a discharge guarantee flag may be set to OFF at a timing when a printing medium is drawn (fed) from a feed port 103 into a printing apparatus 101 in step S506 of FIG. 5. With this arrangement, the discharge guarantee flag is always OFF in a state in which the printing medium exists in the printing apparatus 101 (on a conveyance path).

As in the disk tray undetachment flag, the disk tray undetachment flag is set to ON in step S706 after the disk tray is discharged in the first embodiment. On the other hand, a disk tray undetachment flag may be set to ON at a timing when a user attaches a disk tray 106 in step S703 of FIG. 7. With this arrangement, the disk tray undetachment flag is always ON in a state in which the disk tray 106 exists in the printing apparatus 101.

It is possible to obtain the same effect as in the first embodiment also at a timing when each flag described above is updated.

Third Embodiment

If a printing apparatus 101 includes a sensor capable of determining the extension and accommodation states of a discharge tray 102, a condition below may be added to an execution determination of discharge tray accommodation or discharge tray extension at the start of printing described in the first embodiment.

If the discharge tray 102 has already been accommodated (accommodated state 102*a*) before the removal of a printed product is confirmed with a user in step S603 of FIG. 6, the process ends without accommodating the discharge tray 102. This can omit an unnecessary mechanical operation when the user accommodates the discharge tray 102 manually.

In the process of FIG. 5, if the discharge tray 102 has already been extended (extended state 102*b*), steps S501 to S505 are skipped, and step S506 is executed. Further, if the discharge tray 102 has already been in the extended state 102*b*, a disk tray 106 has already been detached. Thus, at this time, a disk tray undetachment flag may be changed to OFF. This can omit the unnecessary mechanical operation and a confirmation with the user when the user extends the discharge tray 102 in advance.

Fourth Embodiment

An embodiment will be described in which a timing in changing the disk tray undetachment flag described in the first embodiment is changed.

In the first embodiment, the discharge guarantee flag is set to OFF in step S404 after the printing medium is discharged by the mechanical initialization in step S403 of FIG. 4. At this time, if a disk tray 106 may be discharged in step S403, a disk tray undetachment flag may be set to ON accordingly. This can provide a timing for a user to detach the disk tray 106 before a discharge tray 102 is extended in step S501 of FIG. 5 when the disk tray 106 is discharged by mechanical initialization.

OTHER EMBODIMENTS

Embodiments of the present invention can also be realized by a computer of a system or an apparatus that reads out and executes computer executable instructions (e.g., one or more programs) recorded on a storage medium (that may also be referred to more fully as a 'non-transitory computer-readable storage medium') to perform the functions of one or more of the above-described embodiments and/or that includes one or more circuits (e.g., an application specific integrated circuit (ASIC)) for performing the functions of one or more of the above-described embodiments, and by a method performed by the computer of the system or the apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., a central processing unit (CPU), or a micro processing unit (MPU)) and may include a network of separate computers or separate processors to read out and to execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), a digital versatile disc (DVD), or a Blu-ray Disc (BD)™) a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A printing apparatus having a main assembly, the printing apparatus comprising:

(A) a printing unit configured to print on a printing medium;

(B) a discharge tray to which the printing medium printed by the printing unit is stacked, the discharge tray being configured to move between an accommodated position, in which the discharge tray is accommodated in the main assembly, and an extended position, in which the printing medium can be stacked on the discharge tray;

(C) a motor connected to the discharge tray, the motor moving the discharge tray between the accommodated position and the extended position;

(D) an external tray configured to be detachably attached to the printing apparatus in a region in which the discharge tray is movable; and (E) a control unit configured to control the motor, wherein, when the external tray is attached to the printing apparatus, the control unit controls the motor so as not to move the discharge tray from the accommodated position to the extended position.

2. The printing apparatus according to claim 1, wherein if an initialization operation of a printing mechanism of the printing apparatus is performed, the control unit controls the motor so as not to move the discharge tray from the extended position to the accommodated position.

3. The printing apparatus according to claim 1, wherein, if discharge of a printed product by a printing operation is completed normally by the printing apparatus, the control unit controls the discharge tray to be movable from the extended position to the accommodated position.

4. The printing apparatus according to claim 1, further comprising (F) a determination unit configured to determine, when receiving an instruction to power off the printing apparatus, whether the instruction is performed via an operation unit of the printing apparatus, wherein, if the determination unit determines that the instruction is not performed via the operation unit, the control unit controls the motor so as not to move the discharge tray from the extended position to the accommodated position.

5. The printing apparatus according to claim 4, further comprising (G) a receiving unit configured to receive, from an external apparatus, an instruction to power off the printing apparatus, wherein, if the instruction is received from the external apparatus, the control unit controls the motor so as not to move the discharge tray from the extended position to the accommodated position.

6. The printing apparatus according to claim 1, further comprising (F) an instruction unit configured to instruct a user to detach the external tray if the external tray is attached to the printing apparatus at a time of printing.

7. The printing apparatus according to claim 6, wherein, when receiving an instruction to print using the external tray, the control unit controls the motor so as to move the discharge tray from the extended position to the accommodated position, and the instruction unit instructs the user to attach the external tray if the discharge tray is successfully moved to the accommodated position.

8. The printing apparatus according to claim 1, further comprising (F) a sensor configured to detect attachment and detachment of the external tray.

9. A method of controlling a printing apparatus that includes a printing unit configured to print on a printing medium, a discharge tray to which the printing medium, printed by the printing unit, is stacked, a motor for moving the discharge tray between an accommodated position, in which the discharge tray is accommodated in a main assembly of the printing apparatus, and an extended position, in which the printing medium can be stacked on the discharge tray, and an external tray configured to be detachably attached to the printing apparatus in a region in which the discharge tray is movable, the method comprising:

controlling the motor, wherein, when the external tray is attached to the printing apparatus, the motor is controlled so as not to move the discharge tray from the accommodated position to the extended position.

10. The method according to claim 9, wherein, when an initialization operation of a printing mechanism of the printing apparatus is performed, the motor is controlled so as not to move the discharge tray from the extended position to the accommodated position.

11. The method according to claim 9, wherein, if discharge of the printed product by a printing operation is completed normally by the printing apparatus, the motor is controlled so as to allow the discharge tray to be movable from the extended position to the accommodated position.

12. The method according to claim 9, further comprising determining, upon receiving an instruction to power off the printing apparatus, whether the instruction is performed via an operation unit of the printing apparatus, wherein, if it is determined that the instruction is not performed via the operation unit, the motor is controlled so as not to move the discharge tray from the extended position to the accommodated position.

13. The method according to claim 12, further comprising receiving, from an external apparatus, an instruction to power off the printing apparatus, wherein, if the instruction is received from the external apparatus, the motor is controlled so as not to move the discharge tray from the extended position to the accommodated position.

14. The method according to claim 9, further comprising instructing a user to detach the external tray, if the external tray is attached at a time of printing.

15. The method according to claim 14, wherein, when an instruction to print using the external tray is received, the motor is controlled so as to move the discharge tray from the extended position to the accommodated position, and the user is instructed to attach the external tray, if the discharge tray is moved to the accommodated position.

16. The method according to claim 9, further comprising detecting, using a sensor, attachment and detachment of the external tray.

17. A non-transitory computer-readable medium that stores a program for performing a method of controlling a printing apparatus that includes a printing unit configured to print on a printing medium, a discharge tray to which the printing medium, printed by the printing unit, is stacked, a motor for moving the discharge tray from an accommodated position, in which the discharge tray is accommodated in a main assembly of the printing apparatus, and an extended position, in which the printing medium can be stacked on the discharge tray, and an external tray configured to be detachably attached to the printing apparatus in a region in which the discharge tray is movable, the method comprising:

controlling the motor, wherein, when the external tray is attached to the printing apparatus, the motor is controlled so as not to move the discharge tray from the accommodated position to the extended position.

18. The non-transitory computer-readable medium according to claim 17, wherein, when an initialization operation of a printing mechanism of the printing apparatus is performed, the motor is controlled so as not to move the discharge tray from the extended position to the accommodated position.

19. The non-transitory computer-readable medium according to claim 17, wherein, if discharge of the printed product by a printing operation is completed normally by the printing apparatus, the motor is controlled so as to allow the discharge tray to be movable from the extended position to the accommodated position.

20. The non-transitory computer-readable medium according to claim 17, wherein the method further comprises determining, upon receiving an instruction to power off the printing apparatus, whether the instruction is performed via an operation unit of the printing apparatus, and wherein, if it is determined that the instruction is not performed via the operation unit, the motor is controlled so as not to move the discharge tray from the extended position to the accommodated position.

* * * * *